US005242236A

United States Patent [19]

Isac

[11] Patent Number: 5,242,236

[45] Date of Patent: Sep. 7, 1993

[54] PLURAL-SHEET HOLDER

[76] Inventor: Leah Isac, Habanay St. 24,96 264 Jerusalem, Israel

[21] Appl. No.: 808,346

[22] Filed: Dec. 16, 1991

[51] Int. Cl.[5] ..... B42F 3/00

[52] U.S. Cl. ..... 402/9; 402/10

[58] Field of Search ..... 402/9, 10, 8, 6

[56] References Cited

U.S. PATENT DOCUMENTS 1,433,949 10/1922 Hankel ..... 402/9

1,476,767 12/1923 Rubin ..... 402/10

2,317,345 4/1943 Peters ..... 402/9

*Primary Examiner*—Mark Rosenbaum

*Assistant Examiner*—Willmon Fridie, Jr.

*Attorney, Agent, or Firm*—Benjamin J. Barish

[57] ABSTRACT

A holder for holding a plurality of sheets formed with holes adjacent at least one of their edges, comprising: a backing member; at least one slide slidable along each end of a track extending along the width of the upper end of the backing member; and a cord or pair of cords carried by at least one slide and receivable through the openings of a plurality of sheets. The cords include mating connectors at one end to permit the plurality of sheets to be secured together, while the opposite ends of the cords are secured to a length-varying device enabling the effective lengths of the cords to be varied according to the number of sheets to be secured by the cords. In one described embodiment, the length-varying device is a "Velcro" hook and loop fastener; and in a second described embodiment, it is a reel.

20 Claims, 2 Drawing Sheets

PLURAL-SHEET HOLDER

FIELD AND BACKGROUND OF THE INVENTION

The present invention relates to a holder for holding a plurality of sheets. The invention is particularly useful as a holder for holding computer printout sheets, and is therefore described below with respect to this application.

Computer printout sheets represent a widely used means for presenting all kinds of data. As increasing amounts of such data accumulate, and storage space becomes more expensive, there is an increasing need for filing systems employing holders that are capable of providing efficient paper storage while taking up a minimum of space.

The presently-used filing systems employ a large variety of soft or hard cover holders of the following types:

(1) Holders which do not include sheet-securing mechanisms, such that the plurality of sheets are loosely stored with the result that locating and extracting a given sheet is inefficient and the sheets may become disarranged in order. The main advantage of this system is that such holders need be only as thick as the stack of sheets stored and may thus be space-saving.

(2) Holders which include sheet-securing mechanisms, such that the sheets are perforated and are stacked on posts or arms which are clampable to enable efficient securing. One form of such holder employing bendable posts or arms has the advantage of not adding thickness to the holder, and is thus space-saving during storage. However, this type has the following disadvantages: (i) the posts or arms onto which the sheets are stacked are of a standard diameter and of a standard distance between posts, requiring specific perforation of sheets before stacking; and (ii) once stacked and clamped, the retrieval and extraction and/or insertion of a sheet within the stack requires removal of all sheets above the particular sheet.

(3) Holders (sometimes called the "lever-arch" file-type holder) which employ arch-shaped posts each with two arms separable via a lever, or in some cases manually, to allow insertion/extraction of a specific sheet. The advantage of this holder is that it permits a sheet to be inserted/extracted at a given location without the removal of the overlying sheets. A disadvantage, however, is that the "lever arch" type post has a standard height, not all of which can be utilized to stack sheets, as the "arch" section has to be free of sheets. Thus, this holder has a thickness greater than the stack of sheets to be stored, resulting in a waste of storage space. The arch-type posts also have a set distance between each other requiring specific perforation of the sheets to be stacked. In addition, most of these holders employing sheet-stacking posts do not have their posts spaced to accommodate the pre-formed perforations commonly present in computer printouts.

A number of sheet-holder systems have been described, for example, in U.S. Pat. Nos. 1,004,777, 1,644,541, and 4,775,257, and in British Patent No. 802,577, which employ flexible cords for securing the stack of sheets within the holder. However, none of the devices described can efficiently and compactly hold various numbers of sheets, of different arrangements of perforations, and permit the sheet holding capacity to be increased or decreased as may be required.

OBJECTS AND SUMMARY OF THE INVENTION

An object of the present invention is to provide a flexible sheet-holder having advantages in the above respects. More particularly, an object is to provide a sheet holder that: 1) enables insertion/extraction of a specific sheet anywhere in the stack without the removal of overlying sheets; 2) uses, for holding and securing the sheets, a mechanism that is no higher (thicker) than the stack to be so-secured, thereby maximizing efficiency of storage, and; 3) permits accomodation of all kinds of sheets with different arrangements of holes or perforations.

According to the present invention, there is provided a holder for holding a plurality of sheets formed with holes adjacent at least one of their edges, comprising: a backing member; and cord means having at one end two lengths of cords receivable through the holes of a plurality of sheets and terminating in a pair of mating connectors connectible together to permit the plurality of sheets to be secured together by the cord means. The two lengths of cord in the cord means are carried by a common movable member movable along one axis of the backing member for locating the two lengths of cords along the axis with respect to the holes of the sheets to be secured together.

According to further features in the preferred embodiments of the invention described below, the common movable member is slidable along a track extending at the upper end of the backing member along its width. Also, the end of the cord means opposite to that of the two lengths of cords terminating in the pair of mating connectors is secured to a length-varying device enabling the effective lengths of the cord means to be varied according to the number of sheets to be secured by the cords.

The mentioned cord means may be constituted of one cord whose opposite ends terminate in the mating connectors; alternatively, the cord means may include a pair of chords having one of their ends terminating in the mating connectors.

Several embodiments of the invention are described below for purposes of example. In one described embodiment, the length-varying device comprises two fabric strips of a hook-and-loop fastener, e.g., a "Velcro" (Reg. T.M.) fastener. One fabric strip of the hook-and-loop fastener is secured to the opposite end of the cord means, and the other fabric strip of the fastener is fixed to and extending along the respective axis (e.g., width) of the backing member. In a second described embodiment, the length-varying device comprises a reel secured to and slidable with the slide.

In all the described preferred embodiments, there are two of the cord means carried by two slides movably mounted to the opposite sides of the backing member.

Holders constructed in accordance with the foregoing features enable the user to freely adjust the cord spacings and cord lengths as desired, and thereby to store all kinds of sheets securely, to retrieve any specific sheet efficiently, and to minimize the storage space required for each holder. These features make the novel holders particularly useful for storing computer printouts, but of course the novel holders could also be advantageously used in holding or storing other types of sheets. In addition, such holders permit unburst computer printouts held in the holder to be opened 180° and to be completely read and used, thereby saving paper and space.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
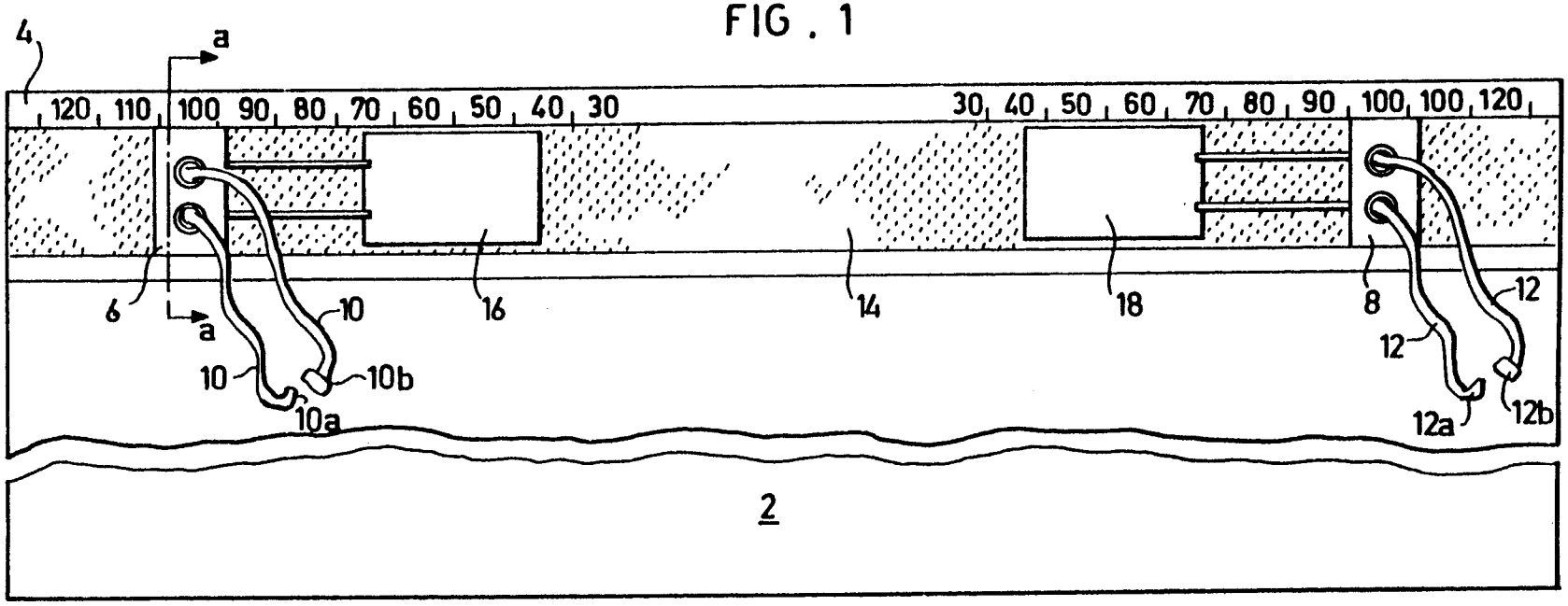
FIG. 1 illustrates one form of holder constructed in accordance with the present invention.
Figure 1A:
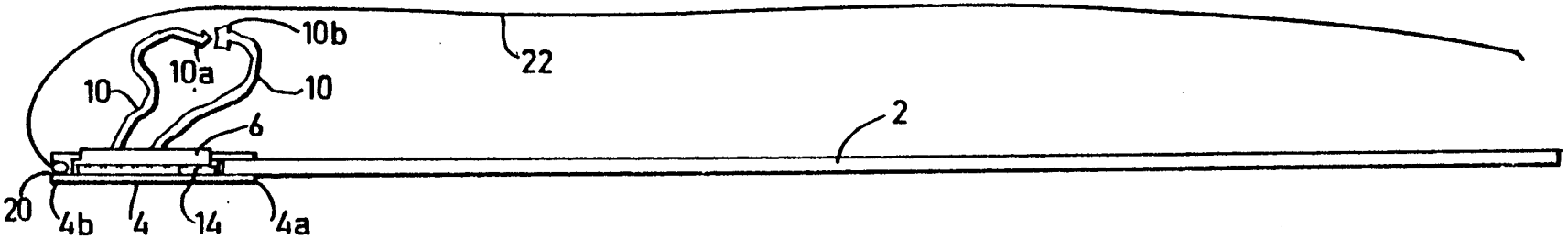
FIG. 1*a* is sectional view along line a—a of FIG. 1.

The Embodiment of FIGS. 1 and 1*a*

The holder illustrated in FIGS. 1 and 1*a* is intended for holding a plurality of sheets (not shown) formed with holes or performations adjacent their opposite edges in order to secure a plurality of sheets together. Normally, the plurality of sheets to be held by each holder would be the same width or length and would have the holes at the same location on the sheet, although the location of the holes on the sheets may be different for different holders. An important feature of the holder illustrated in FIG. 1 is that it can easily accommodate any number of sheets, and substantially any location of the holes thereon, assuming the hole location is the same for all the sheets of the respective holder.

The holder illustrated in FIGS. 1 and 1*a* comprises a backing member 2 having a track 4 secured to and extending along the upper edge of the backing member for its complete width. A pair of slides 6 and 8 are slidably mounted at the opposite ends of track 4 so as to be selectively positionable at any desired location along the width of the backing member.

Each slide 6, 8, carries a pair of cords 10, 12 including mating connectors at one of their ends. For example, the cord pair 10 includes a conical pin 10*a* at the end of one cord, and a conical socket 10*b* at the corresponding end of the other cord of the pair. These mating connectors may be quickly attached to and detached from each other to enable the cords to be pased through the holes of individual sheets and then to be attached together in order to secure the plurality of sheets to the holder.

It will be appreciated that each pair of cords 10, 12, could include two separate cords having the mating connectors at one of their ends, or a single cord folded at an intermediate portion and carrying the mating connectors at its opposite ends.

Track 4 is lined with for its complete length with a long strip 14, constituting one element of a hook-and-loop fastener, such as a "Velcro" (Reg. T.M.) fastener. The ends of the two pairs of cords 10, 12 opposite to their mating connectors (10*a*, 10*b* and 12*a*, 12*b*) are secured to short strips 16, 18 of the other "Velcro" fastener element cooperable with strip 14. For example, the long strip 14 includes the loops of the "Velcro" fastener, whereas each of the short strips 16, 18, includes the hooks of that fastener.

The backing member 2 may be made of stiff cardboard, plastic, metal or the like. The track 4 is preferably made of plastic or metal. As shown in FIG. 1*a*, its opposite edges are of U-configuration. Thus, the inner edge 4*a* of U-configuration is adapted to be secured to the upper edge of the backing member 2; whereas the outer edge 4*b*, also of U-configuration, is adapted to receive the bead 20 of a cover sheet 22 to be applied over the backing member and the stack of sheets held thereby, or to receive part of a drawer. The U-configuration edge 4*b* of track 4 may also be used for suspending the holder and its sheets from a supporting member, such as a supporting rail in a file cabinet.

The holder illustrated in FIGS. 1 and 1*a* may be used in the following manner:

First, the two slides 6, 8, are preset along the track 4 to the proper position so as to locate the respective pairs 10, 12 of cords in alignment with the holes of the sheets to be secured by the holder. When but a few sheets are to be secured by the holder, the two "Velcro" strips 16, 18, would be located closer to the center of track 4, thereby providing relatively short lengths of the cords exiting from the tracks and receivable through the holes in the paper sheets. The paper sheets are secured together by attaching the mating connectors (10*a*, 10*b* and 12*a*, 12*b*) of each pair of cords to each other after the cords have been passed through the holes in the sheets.

Whenever another sheet is to be attached, or a sheet is to be removed, this can be easily done by merely opening the mating connectors and adding or removing the sheet.

If a larger number of sheets are to be held by the holder, the two "Velcro" strips 16, 18, may be moved outwardly along track 4, thereby to increase the length of the cords 10, 12, available for securing the sheets together; and if the number of sheets to be secured is decreased, the "Velcro" strips 16, 18 may be moved inwardly to reduce the lengths of the cords 10, 12 available for securing the sheets together.

It will thus be seen that the holder illustrated in FIGS. 1 and 1*a* efficiently adapts itself to the types of sheets to be held (particularly to the location of the holes through the sheets), and also efficiently adapts itself to the number of sheets to be held.

Figure 2:
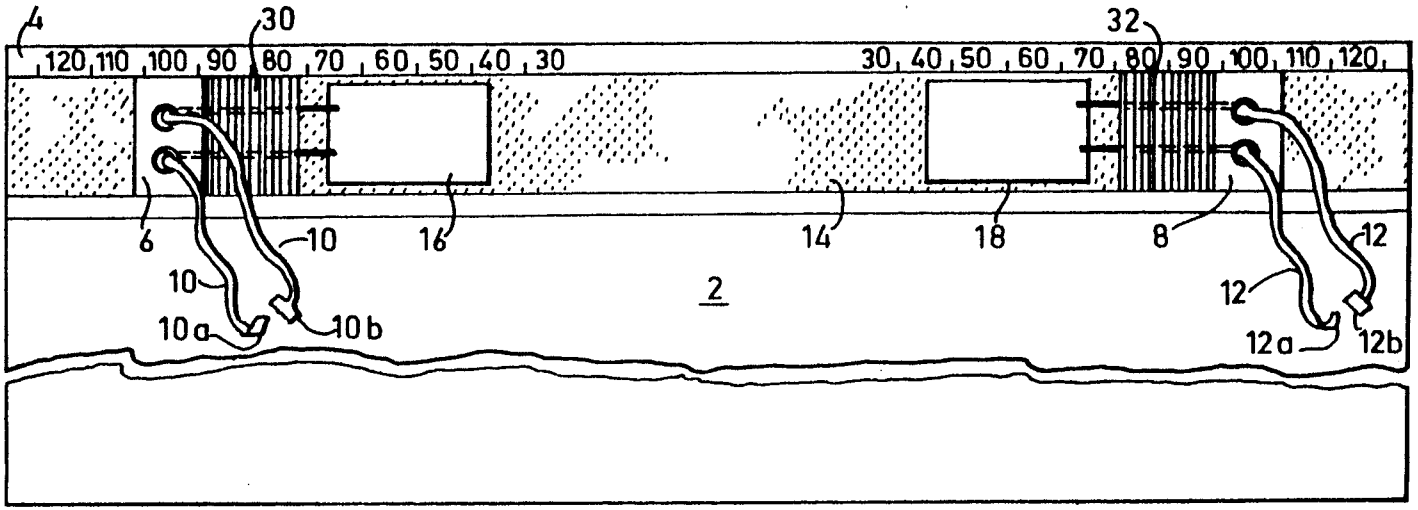
FIGS. 2 and 3 illustrate two other forms of holders constructed in accordance with the present invention.

The Embodiment of FIG. 2

The holder illustrated in FIG. 2 is of very similar construction as that illustrated in FIGS. 1 and 1*a*, and therefore the same reference numerals have been used to identify the corresponding elements in order to facilitate understanding its construction and manner of use. An important difference, however, is that the holder illustrated in FIG. 2 includes a locking member, therein designated 30 and 32, respectively, for each of the two pairs of cords 10, 12, for locking the cords at a preselected length.

Thus, locking member 30 is slidably disposed between slide 6 and Velcro strip 16 and cooperates with cords 10 to lock those cords at any desired length; whereas locking member 32 is slidably disposed between slide 8 and Velcro strip 18 and is cooperable with cords 12 for locking those cords at a preselected length. For example, the two locking members 30, 32, may have inclined underlying surfaces which serve as wedges to lock their respective cords when the locking members are in one position (e.g., adjacent to their respective slides 6, 8 as shown in FIG. 2), and to release the cords when in another position (e.g., adjacent to their respective Velcro strips 16, 18).

Figure 3:
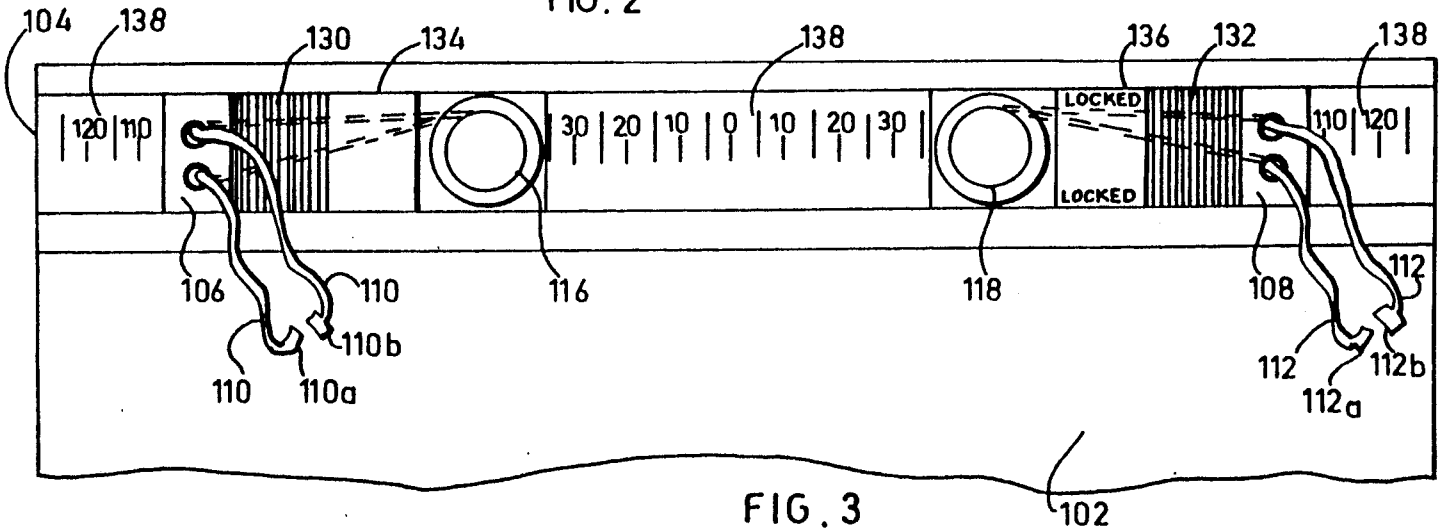

The Embodiment of FIG. 3

FIG. 3 illustrates a further holder constructed similar to that of FIG. 2, except that the length-varying device provided for each pair of cords is in the form of a reel, rather than of a Velcro fastener.

Thus, the holder illustrated in FIG. 3 includes a backing member 102, a track 104 secured to and extending along its upper edge for its complete width, and two slides 106 and 108 slidable along the track and each carrying a pair of cords 110, 112 having mating connectors 110*a*, 110*b*, and 112*a*, 112*b* permitting a plurality of sheets to be secured together. In the holder of FIG. 3, the opposite ends of the cords are secured to a reel 116, 118, respectively, which may be rotated in order to increase or decrease the lengths of the respective pair of cords 110, 112, according to the number of sheets to be secured by the holder.

The holder of FIG. 3 further includes a pair of locking members 130, 132, slidable on track 104 for locking the respective pair of cords at a preselected length. Thus, if the two locking members 130, 132 are slid to the positions illustrated in FIG. 3, adjacent to their respective slides 106, 108, they lock their respective cords 110, 112 (e.g., by a wedging surface as described above wedging the cords between the locking member and the track); whereas when the two locking members are moved to be adjacent to their respective reels 116, 118, they free the cords for changing their effective lengths in order to increase or decrease the number of sheets to be secured by the cords The track 104 may include markings, as shown at 134 and 136, to indicate the locked or unlocked positions of the locking members; and the reels 116, 118, may be spring-biassed in the winding direction, so as to facilitate the extension or retraction of the cords when released by their respective locking members.

The track 104 may include further markings, as shown at 138, to indicate the positions of the slides 106, 108, and thereby of their respective cords 110, 112, from the edges of the track, so as to accommodate sheets having holes at specified locations with respect to the opposite edges of the sheets.

While the invention has been described with respect to several preferred embodiments, it will be appreciated that many other variations and modifications may be made. For example, the holder could include only one pair of cords, each cord carrying one of the mating connectors and mounted on a separate movable member, e.g., a track or a Velcro strip movable along the edge of the backing member. Another variation would be to include more than two pairs of cords, e.g., three or four pairs, movable along the edge of the backing member. Many other variations will be apparent.

What is claimed is:

1. A holder for holding a plurality of sheets formed with holes adjacent at least one of their edges, comprising: a backing member; and cord means having at one end two lengths of cords receivable through the holes of a plurality of sheets and terminating in a pair of mating connectors connectible together to permit the plurality of sheets to be secured together by said cord means;

said two lengths of cords in said cord means being carried by a common movable member movable along one axis of the backing member for locating said two lengths of cords along said axis with respect to the holes of the sheets to be secured together.

2. The holder according to claim 1, wherein said common movable member is slidable along a track extending at one end of the backing member along its width.

3. The holder according to claim 1, wherein said cord means has an end opposite to that of said two lengths of cords terminating in said pair of mating connectors which opposite end is secured to a length-varying device enabling the effective length of the cord means to be varied according to the number of sheets to be secured by the cord means.

4. The holder according to claim 3, wherein said length-varying device comprises two fabric strips of a hook-and-loop fastener, one fabric strip of said hook-and-loop fastener being secured to said opposite end of the cord means, the other fabric strip of the hook-and-loop fastener being fixed to and extending along the respective axis of the backing member.

5. The holder according to claim 3, wherein said length-varying device comprises a reel to which said opposite end of the cord means is secured.

6. The holder according to claim 5, wherein said reel is slidable on a track.

7. The holder according to claim 1, wherein said two lengths of cords in said cord means are constituted of two separate cords each having one end terminating in one of said mating connectors.

8. The holder according to claim 1, wherein said cord means are constituted of a single cord whose opposite ends terminate in said mating connectors.

9. The holder according to claim 1, wherein there are two of said cord means, each having at one end two lengths of cords terminating in a pair of said mating connectors and carried by said movable member at one of the opposite sides of the backing member.

10. The holder according to claim 9, wherein the end of each of said two cord means opposite to that of said two lengths terminating in said pair of mating connectors is secured to a length-varying device enabling the effective length of each cord means to be varied according to the number of sheets to be secured by the cord means.

11. The holder according to claim 10, wherein each of said length-varying devices comprises two fabric strips of a hook-and-loop fastener carried by the respective cord means, one fabric strip of said hook-and-loop fastener being secured to said opposite end of the cord means, the other fabric strip of the hook-and-loop fastener being in the form of a strip fixed to and extending along the width of the backing member.

12. The holder according to claim 10, wherein, each of said length-varying devices comprises a reel.

13. A holder for holding a plurality of sheets formed with alignable holes, said holder comprising:

a backing member;

cord means having at one end two lengths of cord terminating in a pair of mating connectors connectible together after having been passed through the holes of said sheets to secure the sheets together;

said cord means having an opposite end secured to a length-varying device enabling the effective length of the cord means to be varied according to the number of sheets to be secured by the cord means.

14. The holder according to claim 13, wherein said length-varying device comprises a reel.

15. The holder according to claim 13, wherein said length-varying device comprises two fabric strips of a hook-and-loop fastener, one fabric strip of said hook-and-loop fastener being secured to said opposite end of the cord means, the other fabric strip of the hook-and-loop fastener being fixed to and extending along the backing member.

16. The holder according to claim 13, wherein said cord means is carried by a movable member movable along one axis of the backing member for locating the cord means along said axis with respect to the holes of the sheets to be secured together.

17. The holder according to claim 16, wherein said backing member is secured to one side of a track extending along the width of the backing member, said movable member being movable along said track.

18. The holder according to claim 13, wherein said cord means are constituted of two separate cords each having one end terminating in one of said mating connectors.

19. The holder according to claim 13, wherein said two lengths of cords in said cord means are constituted of a single cord whose opposite ends terminate in said mating connectors.

20. The holder according to claim 13, wherein there are two of said cord means, each having at one end two lengths of cords terminating at one end in said pair of mating connectors, the opposite ends of said two cord means being carried by a movable member movable along said backing member.

* * * * *